US005189130A

United States Patent [19]

Kageyama

[11] Patent Number: 5,189,130

[45] Date of Patent: Feb. 23, 1993

[54] SNOW SKI BASE MATERIAL AND SKI BASE MANUFACTURE

[75] Inventor: Norihiko Kageyama, Hamamatsu, Japan

[73] Assignee: Yamaha Corporation, Hamamatsu, Japan

[21] Appl. No.: 640,860

[22] Filed: Jan. 14, 1991

[30] Foreign Application Priority Data

Jan. 19, 1990 [JP] Japan ..... 2-9550

[51] Int. Cl.[5] ..... C08F 110/02

[52] U.S. Cl. ..... 526/352

[58] Field of Search ..... 526/352; 528/503, 499

[56] References Cited

U.S. PATENT DOCUMENTS 3,944,536 3/1976 Lupton et al. ..... 528/503

FOREIGN PATENT DOCUMENTS 61-82772 4/1986 Japan .

62-217980 9/1987 Japan .

OTHER PUBLICATIONS

Renfrew and Morgan, Polythene (The Technology and Uses of Ethylene Polymers), 1st Ed., pp. 91–118.

*Primary Examiner*—Joseph L. Schofer

*Assistant Examiner*—David Wu

*Attorney, Agent, or Firm*—Burns, Doane, Swecker & Mathis

[57] ABSTRACT

A high performance ski base material is made of ultra high molecular weight polyethylene having a molecular weight of at least 500,000. After heating, quenching and light tensioning operations, this material exhibits low crystallinity and high transparency characteristics. Such material is ideal for professional high speed skis because of its excellent wax retention quality. The invented ski base material is ideally suited for product-identity purposes because of its outstanding ability to clearly reveal detailed inscriptions placed on the running surface of a ski board.

4 Claims, 1 Drawing Sheet

SNOW SKI BASE MATERIAL AND SKI BASE MANUFACTURE

FIELD OF THE INVENTION

This invention relates to an improved snow ski base material made of ultra high molecular weight polyethylene (UHMWPE) and a quenching method of manufacturing a base (known as a "sole") for high performance snow skis, having improved transparency and wax absorbing capability.

PRIOR ART

Wear resistant snow ski bases made of UHMWPE group materials have been known, such as those disclosed in Japanese Laid-Open Patent Publications, Sho61-82772 and Sho62-217980, for example.

However, such UHMWPE materials as disclosed in Sho61-82772, for example, often exhibit poor ability to spread wax and even less ability to permit the wax to penetrate into itself, and consequently, such bases lacked fast running capabilities in adverse snow conditions

SUMMARY OF THE INVENTION

The purpose of the present invention is to provide a UHMWPE snow ski base material (hereinafter referred to as ski base material) which has high wax absorbing and retaining capabilities.

According to an aspect of this invention, there is provided a UHMWPE ski base material having a molecular weight not less than 500,000 and light transmissivity not less than 10%.

According to another aspect of this invention, there is provided an UHMWPE ski base material having wax absorbing capability of not less than 1.8 mg/cm$^2$.

According to still another aspect of this invention, there is provided a method of manufacturing a snow ski base (hereinafter referred to as a ski base) using said UHMWPE material by heating it to a controlled melting state followed by quenching.

DETAILED DESCRIPTION OF THE PRESENT INVENTION

Figure 1:
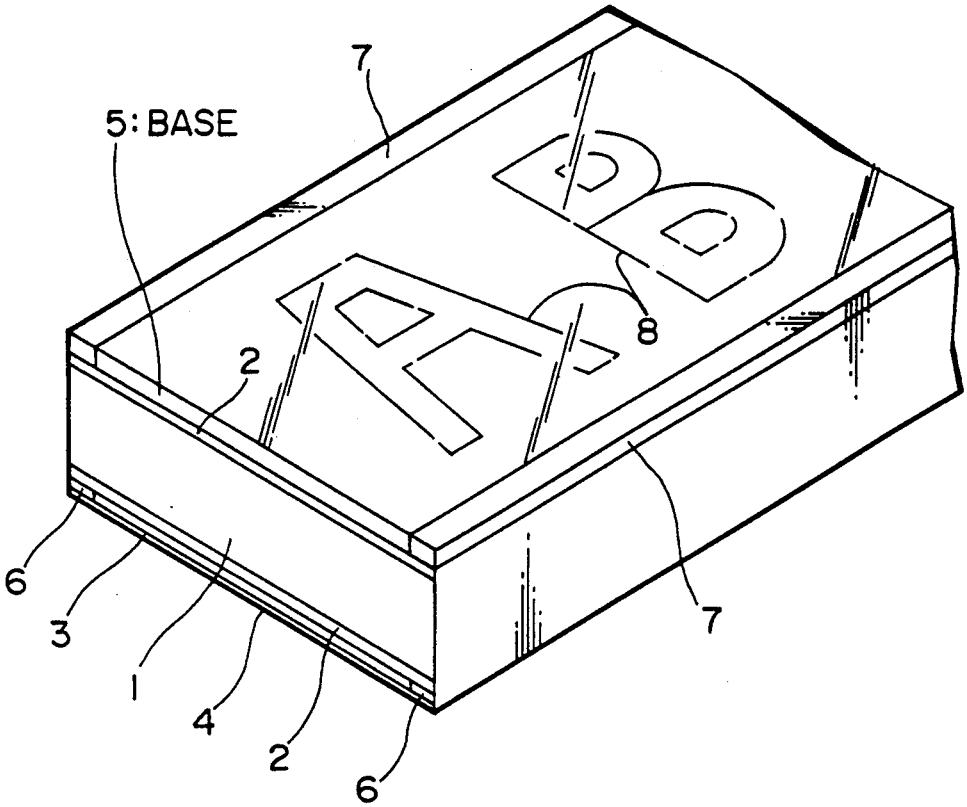
FIG. 1 is an angle view of a cross section of a ski board to illustrate its construction.

FIG. 1 shows a cross section of a ski board made with the ski base material presented in this invention, and shows a number of components referenced by reference numerals. The reference numeral 1 is a core material, made of foamed resins such as foamed polyurethane and acrylic resins. The core is laminated with top and bottom reinforcing laminations 2, which are made of strip materials made of metals such as high strength aluminum alloys, and non-metals such as glass-fiber or carbon-fiber reinforced polymeric strip materials. The top surface of the above assembly is provided with a decorative component 3, which is further covered with a clear protective layer 4, of thickness 20 to 100 μm, made of urethane or unsaturated polyester resins, so that the decoration is visible. The clear layer 4 is the topmost outer surface of the ski board.

The bottom reinforcing lamination 2 is shown in this figure facing the top of the page and is affixed with said base material 5 of thickness 0.5 to 1.5 mm. The surface thus constructed of said ski base material becomes the running surface 5 in contact with the snow. Therefore, although shown at the bottom of the ski board in this figure, the numeral 6 refers to cosmetic edge protectors, made of aluminum alloys, disposed on the top surface of the ski board when it is being used, and the numeral 7 refers to running edges, made of carbon steels and other hard metallic materials, disposed on the running surface.

The above base material 5 is made of UHMWPE having the molecular weight of not less than 500,000, having melt index not more than 0.01, having density not more than 0.93 g/cm$^3$ and the degree of crystallinity not more than 55%.

When the ski base is made from an UHMWPE material having the molecular weight not less than 500,000 and light transmissivity not less than 10%, because non-crystalline regions are distributed throughout the base thickeness, wax absorbing capability of the base is increased to not less than 1.8 mg per cm$^2$ of running surface of the base, compared with the conventional similar materials. This is because many regions where crystallization is suppressed, such as amorphous or pracrystalline regions, are distributed throughout from the surface to the inside of the ski base.

The definitions of the light transmissivity and wax absorbing capability will be defined later.

A method of manufacturing the base using such an UHMWPE material will be described next.

A powder of UHMWPE material, of molecular weight not less than 500,000 and preferably not less than 1,000,000 and further having melt index not more than 0.01, is selected from such potential materials as "Highzex Million" made by Mitsui Oil and Chemicals or "Hostallen GUR" made by Hochest Chemicals. The molecular weight referred here is that measured by the viscosity method. This powder is charged into a metal mold and hot pressed to produce a disc-shaped preform. Hot pressing conditions were, for example, pressing at 10 MPa for 5 to 10 minutes at room temperature, followed by pressing at 2 to 5 MPa at temperatures between 200° to 250° C. for 7 to 10 hours, and ending in cooling over a period of 4 to 7 hours while increasing the pressure gradually to 10 MPa.

This disc-shaped preform is subjected to skiving (to peel off a thin layer from the outer periphery) to obtain a thin polyethylene strip having the same width as the preform and a thickness in the range of 0.5 to 2 mm.

The strip is cut into a suitable length for a ski board, and is heated by a suitable method to temperatures in the rang of 140° to 150° C. for a period of 10 to 30 minutes. What is required in this processing step is to soften the polyethylene strip sufficiently for the subsequent processing step. Therefore, the choice of heating method could include any one of heating methods such as far-infrared heating, resistive heating, gas flame and high pressure steam. It is desirable to maintain the strip in a horizontal position during heating. It is also desirable to prevent the oxidation of its surface by protecting the strip in between two films of polyethylene telephthalate, Teflon, aluminum foils or by heating the strip in a protective atmosphere such as in inert gas.

In this processing step, if the molecular weight is over 500,000, i.e. its melt index is not more than 0.01, it is possible to prevent its liquefaction and retain the bulk shape of the UHMWPE material which would just become rubbery under the above specified conditions.

The heated strip can then be hung vertically without losing its form entirely.

When all the crystalline phases in the UHMWPE strip have been melted or become amorphous and transparent, the strip is taken out of the furnace and is quenched immediately by immersing it in an quenching medium such as cold water. The quenching medium can also be a mixture of alcohol and dry ice or liquid nitrogen, or other low temperature liquid medium which has high heat capacity. The cooling rate should be no less than 100° C./s, and preferably in excess of 200° C./s in order that the amorphous phase will increase thus leading to high absorbing capability of wax. Quenching methods include placing a quenching bath, large enough to contain the strip, beside the heating furnace so that the strip can be immersed in the bath within one second of taking it out of the furnace.

Such rapid cooling of heated UHMWPE strip promotes retention of the amorphous state of the softened material and suppresses crystallization during cooling.

The distortions of the UHMWPE strip created by quenching stresses are corrected by reheating the quenched strip to 70° to 90° C., and stretching the strip in the longitudinal direction for several minutes, and cooling it under tension.

The base material thus produced is further subjected to such surface activation steps as flame treatment so that adhesive property of the base material will improve, and after this treatment, the surface layer of the base material is removed slightly to finish it as the running surface. Then, bonding among the base materials, the reinforcements 2, and the core material 1 is carried out by the conventional techniques to produce a ski board.

The crystalline phase through the thickness of the UHMWPE base material thus obtained has been kept to a minimum from the surface to the inside by the combined action of controlled heating and rapid quenching, and the base made of such a material has superior transparency and light transmissivity compared with the conventional sintered ski base. In the present invention, the acceptable base material is defined a those having light transmissivity of not less than 10%.

Light transmissivity is based on the wave length of 517 nm transmitted through an UGHMWPE sample of 1.00 mm thickness. The method of measurement is as follows. A sample for light transmission measurement is prepared by polishing and spreading silicon oil on the two surfaces of a quenched strip, and covering the two surfaces with microscope slide glasses so as to fill the capillary space between the sample and the slide glass with the silicone oil. This is to avoid the light scattering effects due to the presence of irregularities on the UHMWPE sample surface. A comparative reference is also made in the form of a sandwiched slide glasses filled with the same silicon oil. Light transmission through the sample is measured with a spectrophotometer at the wave length of 517 nm, and the transmissivity at the exact thickness of 1.00 mm is calculated according to Lambert's Law.

The UHMWPE material having light transmissivity of not less than 10% has good transparency and the ski base prepared from such a material provides excellent visibility of the patterns/printing 8 conferred on the surface of the reinforcing laminations 2 through the transparent ski base material 5 adapted to become the running surface, as depicted in FIG. 1. Because the base is clear, even fine details can be seen vividly on the ski base, compared with the conventionally prepared ski base materials.

Furthermore, the base materials made of UHMWPE having not less than 10% transmissivity has a superior wax absorbing capability as represented by a figure of 1.8 mg per one $cm^2$ of the running surface.

As demonstrated in the foregoing preferred embodiment, the ski base prepared by heating and quenching UHMWPE material according to this invention has not less than 10% light transmissivity as the crystallization is suppressed from the surface to the inside of the base and provides outstanding transparency and wax absorbing capability.

Therefore, the skis equipped with the invented ski base require waxing less often and are able to provide excellent performance advantages, over other skis with a conventional ski base, when skiing on wet snow, new snow, long distance skiing and other adverse conditions in which waxing could provide the critical winning edge.

Furthermore, because the base has good transparency, it provides a excellent visibility of the decorative patterns and inscriptions thereon, thus furnishing outstanding opportunity for product-identification.

Wax absorbing capability is measured as follows. A sample of UHMWPE of 40 mm×25 mm is weighed to obtain its initial weight ($W_O$, mg) and the surface area measurements (A, $cm^2$) are made. It is then immersed in molten paraffin, having a melting range of 52° to 54° C. (DAB 9 or DAB 8, for example Merk No. 7152), maintained at 110° C.±2° C. After ten minutes of immersion, the sample is taken out and wiped immediately with absorbing cloth or paper. The sample is allowed to cool for ten seconds and then is immersed in a solution of diethylether for ten seconds to remove traces of surface wax. The cleaned sample is weighed to determine the new sample weight (M) and the amount of wax absorbed W is calculated according to the following formula.

$$W=(M-M_0)/A\ .\ (mg/cm^2)$$

It has been found that those UHMWPE samples, exhibiting light transmission values of not less than 10%, have high values of wax absorbing capability. It is believed that these samples have low degrees of crystallinity and high degrees of amorphousness, and because the amorphous material has good miscibility with wax, the wax absorbing capability of such amorphous materials is increased.

It has furthermore been found that those samples of UHMWPE having not less than 10% light transmissivity show low degrees of crystallinity of around 55% or less.

The degree of crystallinity is determined from the density of UHMWPE as follows. The formula for the degree of crystallinity of a sample having a density d is given by the values of the density of crystalline phases $d_c$ and amorphous phase $d_a$ respectively according to the following formula.

$$\text{DEGREE OF CRYSTALLINITY}\ (\%)=[d_c(d-d_a)]/[d(d_c-d_a)]\times 100$$

where the values of $d_c$ and $d_a$ are taken as 1.000 g/$cm^3$, and 0.856 g/$cm^3$, respectively. Therefore, a density value can be determined readily on a small sample piece cut out of a heat treated strip by using a density gradient tube (i.e. a tube containing stratified layers of liquids of varying densities).

In the following, some cases of preferred embodiments are presented.

A FIRST PREFERRED EMBODIMENT

An UHMWPE preform having a molecular weight of 4,000,000 was made into a test sample measuring 10 cm width×200 cm length×1.0 mm thickness by skiving. This material exhibited 62.6% crystallinity, 1.54 mg/cm$^2$ wax absorbing capability and 6% light transmissivity.

The above material was made into a ski base material by heating for 20 minutes at 150° C., quenching in water at 10° C. and shaping using light tensioning at 60° C. This ski base material exhibited 51.7% crystallinity, 0.925 g/cm$^3$, 2.18 mg/cm$^2$ wax absorbing capability and increased its light transmissivity to 33.7%.

A SECOND PREFERRED EMBODIMENT

An UHMWPE preform having a molecular weight of 6,000,000 was made into a ski base material by using the same procedure as in the first preferred embodiment. The untreated material exhibited 56.8% crystallinity, 1.58 mg/cm$^2$ wax absorbing capability and 7.01% light transmissivity.

The above material was heat treated at 140° C. for 30 minutes and quenched in water at 20° C. This material was treated by the same shaping procedure as in the first preferred embodiment.

The ski base material thus prepared exhibited 50.7% crystallinity, 0.923 g/cm$^3$, 2.01 mg/cm$^2$ wax absorbing capability and improved its light transmissivity to 18.5%.

A THIRD PREFERRED EMBODIMENT

An UHMWPE preform having a molecular weight of 8,000,000 was made into a ski base material by using the same procedure as in the first preferred embodiment. The untreated material exhibited 58.4% crystallinity, 1.47 mg/cm$^2$ wax absorbing capability and 8.5% light transmissivity.

The above material was heat treated at 160° C. for 10 minutes and quenched in water at 0° C. This material was shaped by the same shaping procedure as in the first preferred embodiment.

The ski base material thus prepared exhibited 50.9% crystallinity, 0.925 g/cm$^3$, 2.40 mg/cm$^2$ wax absorbing capability and improved its light transmissivity to 16.2%.

COMPARATIVE EXAMPLE NO. 1

A ski base material of 1.5 mm thickness was made by extruding an UHMWPE having a molecular weight of 100,000. The crystallinity was 72.6%, its wax absorbing capability was 1.57 mg/cm$^2$ and light transmissivity was 1.4%.

COMPARATIVE EXAMPLE NO. 2

An UHMWPE material having a molecular weight of 200,000 was made into a ski base material by the process described in the first preferred embodiment.

The above material was heat treated at 150° C. for 20 minutes, it was then discovered that quenching cannot be performed a the material had become too fluid.

What is claimed is:

1. A snow ski base material consisting essentially of ultra high molecular weight polyethylene having a molecular weight of not less than 500,000, a light transmissivity of not less than 10%, a density of not more than 0.93 g/cm$^3$ and a degree of crystallinity quality of not more than 55%.

2. A snow ski base material according to claim 1, further consisting of a melt index quality of not more than 0.01.

3. A snow ski base material according to claim 1, further comprising:

a quality of wax absorbing capability of not less than 1.8 mg per one square centimeter of running surface area.

4. A snow ski case material according to claim 2, further comprising:

a quality of wax absorbing capability of not less than 1.8 mg per one square centimeter of running surface area.

* * * * *